US006711821B1

(12) United States Patent
Clarke

(10) Patent No.: US 6,711,821 B1
(45) Date of Patent: Mar. 30, 2004

(54) HEATED CANDLE-CUTTING DEVICE

(76) Inventor: Cynthia A. Clarke, 345 Merton St. #306, Toronto, Ontario (CA), M4S-1B5

( * ) Notice: Subject to any disclaimer, the term of this patent is extended or adjusted under 35 U.S.C. 154(b) by 23 days.

(21) Appl. No.: 10/139,038

(22) Filed: May 4, 2002

(51) Int. Cl.[7] ..... B26B 3/00; B26B 9/00
(52) U.S. Cl. ..... 30/140
(58) Field of Search ..... 30/140, 313; 126/226, 126/401; 219/221

(56) References Cited

U.S. PATENT DOCUMENTS 3,208,142 A * 9/1965 Osrow ..... 30/140
3,352,011 A * 11/1967 Alexander et al. ..... 30/313

* cited by examiner

*Primary Examiner*—Douglas D. Watts

(57) ABSTRACT

A heated candle-cutting device for cutting candles in order to extend the use of the candle. The heated candle-cutting device includes an elongated handle that is grasped by a hand of a user. An elongated blade is mounted on the handle for cutting a portion of a candle. A heating element is mounted in the blade for heating the blade making cutting the candle easier. A power source is coupled to the heating element for selectively providing power to the heating element. A switch is mounted to the handle for selectively controlling the power source to the heating element.

8 Claims, 6 Drawing Sheets

HEATED CANDLE-CUTTING DEVICE

BACKGROUND OF THE INVENTION

1. Field of the Invention

The present invention relates to knives and more particularly pertains to a new heated candle-cutting device for cutting candles in order to extend the use of the candle.

2. Description of the Prior Art

The use of knives is known in the prior art. More specifically, knives heretofore devised and utilized are known to consist basically of familiar, expected and obvious structural configurations, notwithstanding the myriad of designs encompassed by the crowded prior art that have been developed for the fulfillment of countless objectives and requirements.

Known prior art includes U.S. Pat. No. 5,438,758; U.S. Pat. No. 3,869,794; U.S. Pat. No. 1,451,163; U.S. Pat. No. 6,053,217; U.S. Pat. No. 6,076,262; U.S. Pat. No. 5,774,995; and U.S. Pat. No. 3,919,522.

Although the advent of electricity made the dependency of candles for light less, it did not diminish their popularity. Today, people use candles for decoration and for setting a particular mood. A problem that persists with candles is that often a wick of a candle burns down to a point that the candle can no longer be used requiring the user to prematurely purchase a new candle.

For years people have tried to pour melted candle wax away from the wick in hopes of extending the life of the candle. The problem encountered is that the wick is eventually positioned in a bore extending into the candle. The heat from the ignited wick continues to melt the candle wax around the wick, suffocating the ignited wick, until the candle can no longer be effectively used. Devices have been invented that trim the wick of a candle in hopes of reducing the flame and extending the life of the candle. Other devices trim the wax away from the wick in hopes of reducing the amount of suffocating melted wax. Although the devices would extend the life of a candle, eventually the wick would burn so low that it would create a bore extending into the candle making the candle effectively unusable.

SUMMARY OF THE INVENTION

In view of the foregoing disadvantages inherent in the known types of knives now present in the prior art, the present invention provides a new heated candle-cutting device construction wherein the same can be utilized for cutting candles in order to extend the use of the candle.

The general purpose of the present invention, which will be described subsequently in greater detail, is to provide a new heated candle-cutting device apparatus and method which has many of the advantages of the knives mentioned heretofore and many novel features that result in a new heated candle-cutting device which is not anticipated, rendered obvious, suggested, or even implied by any of the prior art knives, either alone or in any combination thereof.

The inventive device includes an elongated handle that is grasped by a hand of a user. An elongated blade is mounted on the handle for cutting and removing a portion of a candle and a portion of a wick of the candle. A heating element is mounted in the blade for heating the blade making cutting the candle easier. A power source is coupled to the heating element for selectively providing power to the heating element. A switch is mounted to the handle for selectively controlling the power source to the heating element.

There has thus been outlined, rather broadly, the more important features of the heated candle-cutting device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is an object of the present invention to provide a new heated candle-cutting device apparatus and method which has many of the advantages of the knives mentioned heretofore and many novel features that result in a new heated candle-cutting device which is not anticipated, rendered obvious, suggested, or even implied by any of the prior art knives, either alone or in any combination thereof.

Still another object of the present invention is to provide a new heated candle-cutting device for cutting candles in order to extend the use of the candle.

Still yet another object of the present invention is to provide a new heated candle-cutting device that employs a heated blade that cuts through a candle and wick more easily than a conventional knife.

Even still another object of the present invention is to provide a new heated candle-cutting device that cuts a candle and the wick. The shortened wick and removed wax extends the effective use of the candle. The trimmed wick and candle also produces less black smoke and soot, thereby making the candle more attractive when lit.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
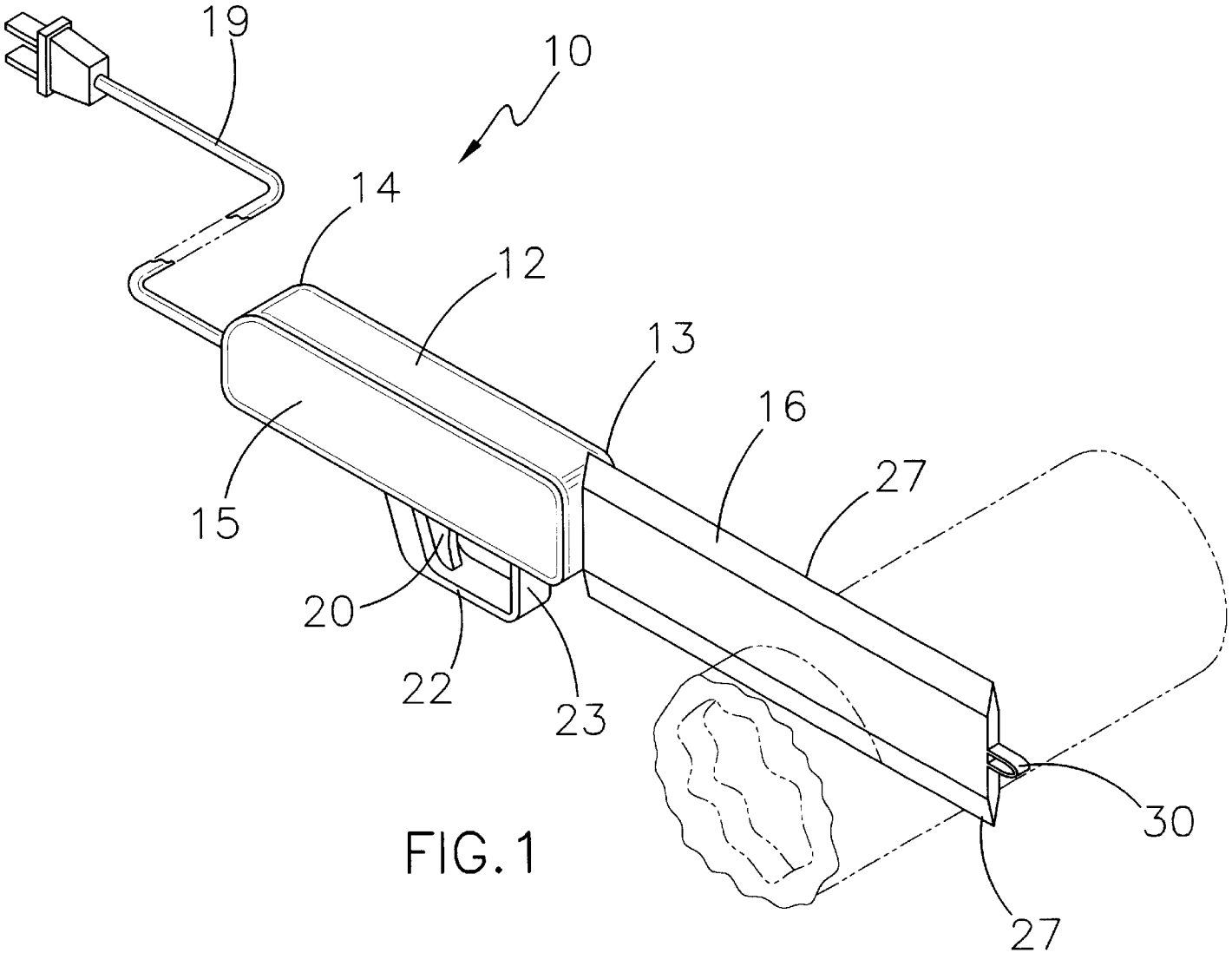
FIG. 1 is a perspective view of a new heated candle-cutting device according to the present invention.

With reference now to the drawings, and in particular to FIGS. 1 through 6 thereof, a new heated candle-cutting device embodying the principles and concepts of the present invention and generally designated by the reference numeral 10 will be described.

As best illustrated in FIGS. 1 through 6, the heated candle-cutting device an elongated handle 12 for being grasped by a hand of a user. An elongated blade 15 is mounted on the handle 12 for cutting a candle. A heating element 18 is mounted in the blade 15 for heating the blade 16 to a temperature capable of melting the wax of a candle. A power source 19 is coupled to the heating element 18 for selectively providing power to the heating element 18. A switch 20 is mounted to the handle 12 for selectively controlling the power source 19 to the heating element 18.

The elongated handle 12 may have a first end 13, a second end 14 and a peripheral wall 15 that extends therebetween. The blade 16 is preferably mounted on the first end 13 of the elongated handle. The handle may have a generally transverse rectangular cross section taken substantially perpendicular to a longitudinal axis of the handle. However, the elongated handle 12 may have a variety of shapes and sizes.

In one embodiment of the present invention, as particularly illustrated in FIG. 1, the switch 20 may be mounted on the peripheral wall 15 of the elongated handle 12. The switch 20 may be generally arcuate having a shape resembling a trigger. The switch 20 may comprise any type of switch such as, for example, a push-button or slide switch.

As particularly illustrated in FIG. 1, the elongated handle 12 may also include a guard member 22 for protecting a users finger from contacting the hot melted wax or the blade 16. The guard member 22 may be mounted on the handle 12 and may extend over the switch 20. The guard member 22 may be generally arcuate and it may have a pair of opposed ends 23 that are coupled to the peripheral wall 15 of the handle 12.

The elongated handle 12 may comprise a substantially rigid material such as, for example, a plastic material. However, the elongated handle 12 may comprise a variety of materials.

As particularly illustrated in FIG. 1, the blade 16 may have a first end 25, a second end 26 and a pair of opposed elongated edges 27. In one embodiment of the present invention, at least one of the edges 27 is tapered and sharpened. In another embodiment of the present invention, both elongated edges 27 are tapered and sharpened permitting a user to use both elongated edges 27 to cut a candle.

Figure 2:
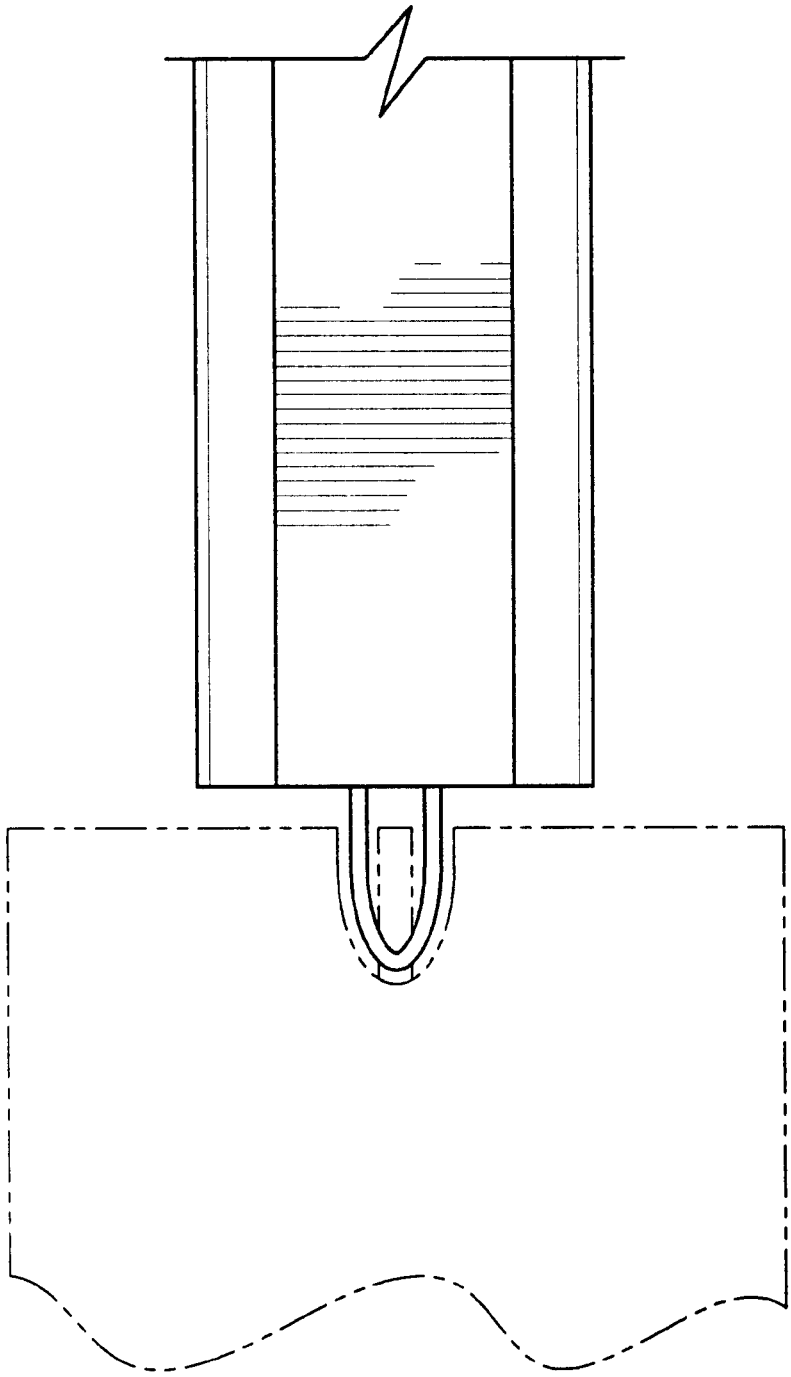
FIG. 2 is a fractional frontal elevational view of the present invention.
Figure 3:
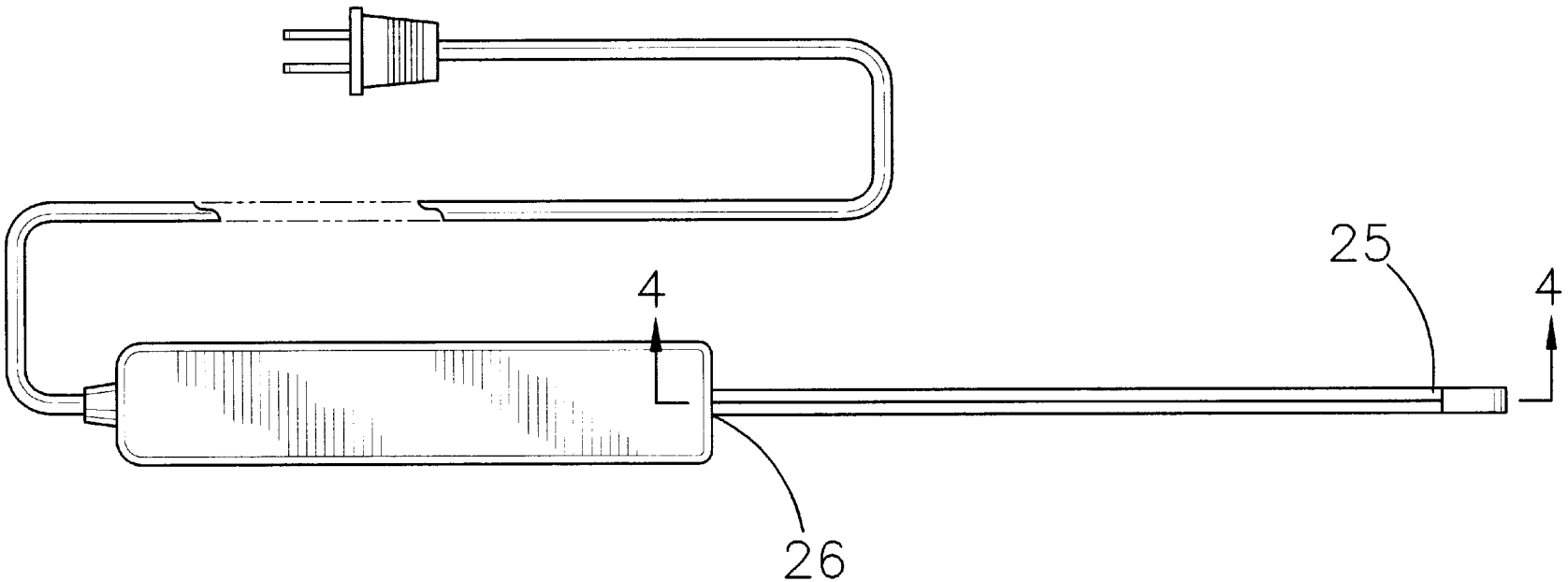
FIG. 3 is a top planar view of the present invention.
Figure 4:
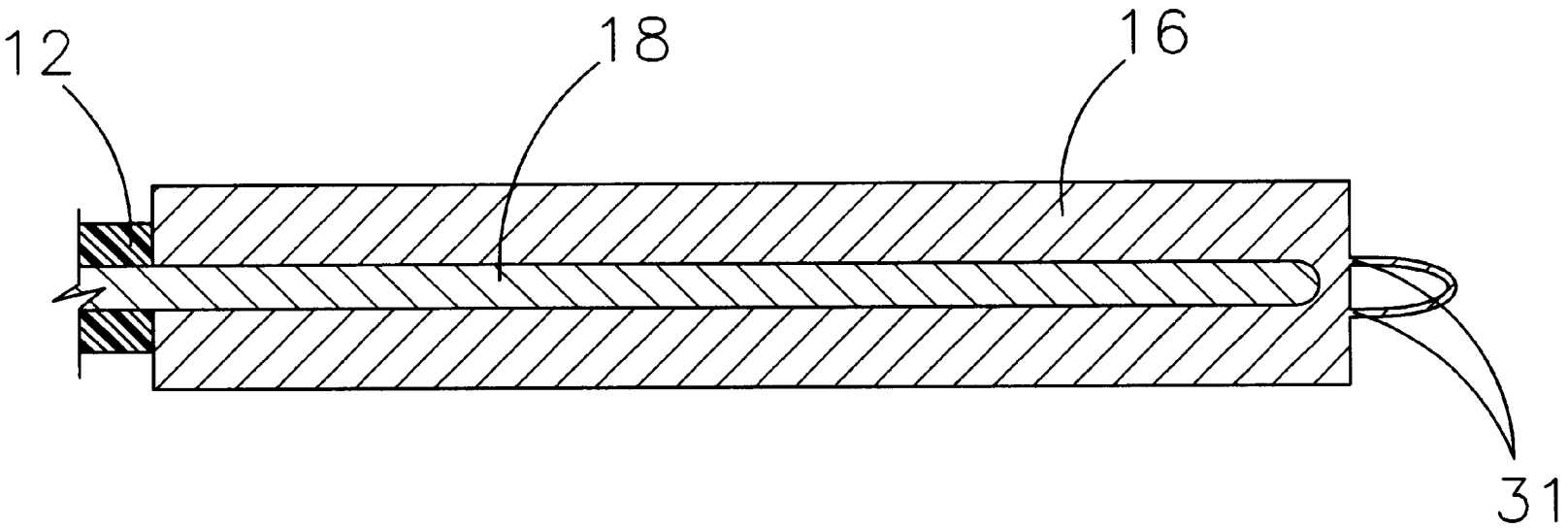
FIG. 4 is a cross-sectional view of the present invention taken along line 4—4 of FIG. 3.

In one embodiment of the present invention, as particularly illustrated in FIGS. 1, 2 and 4, a scoop 30 is mounted on the first end 25 of the blade 16 for scooping a portion of the candle away from a wick extending through the candle. The scoop 30 may be generally arcuate and may have a pair of opposed ends 31 that are mounted to the first end of the blade 16. The scoop 30 is preferably positioned generally adjacent to an end of the heating element 18 extending through the blade 16, thus heating the scoop 30 permitting a user to more easily scoop a portion of the candle from around the wick.

The power source 19, as particularly illustrated in FIGS. I and 3 may comprise an electrical cord for carrying an electric current to the heating element 18. However, the power source 19 may also comprise fuel cells, batteries, propane or any other type of power source capable of heating the heating element 18.

The heating element 18 may be elongated and may extend along a longitudinal axis of the blade 16. The heating element 18 may comprise any material capable of converting power from the power source 19 to heat that is absorbed by and emitted from the blade 16. The heating element 18 may comprise a copper, or aluminum material. However, any material capable of converting power from the power source 19 to heat may be employed.

Figure 5:
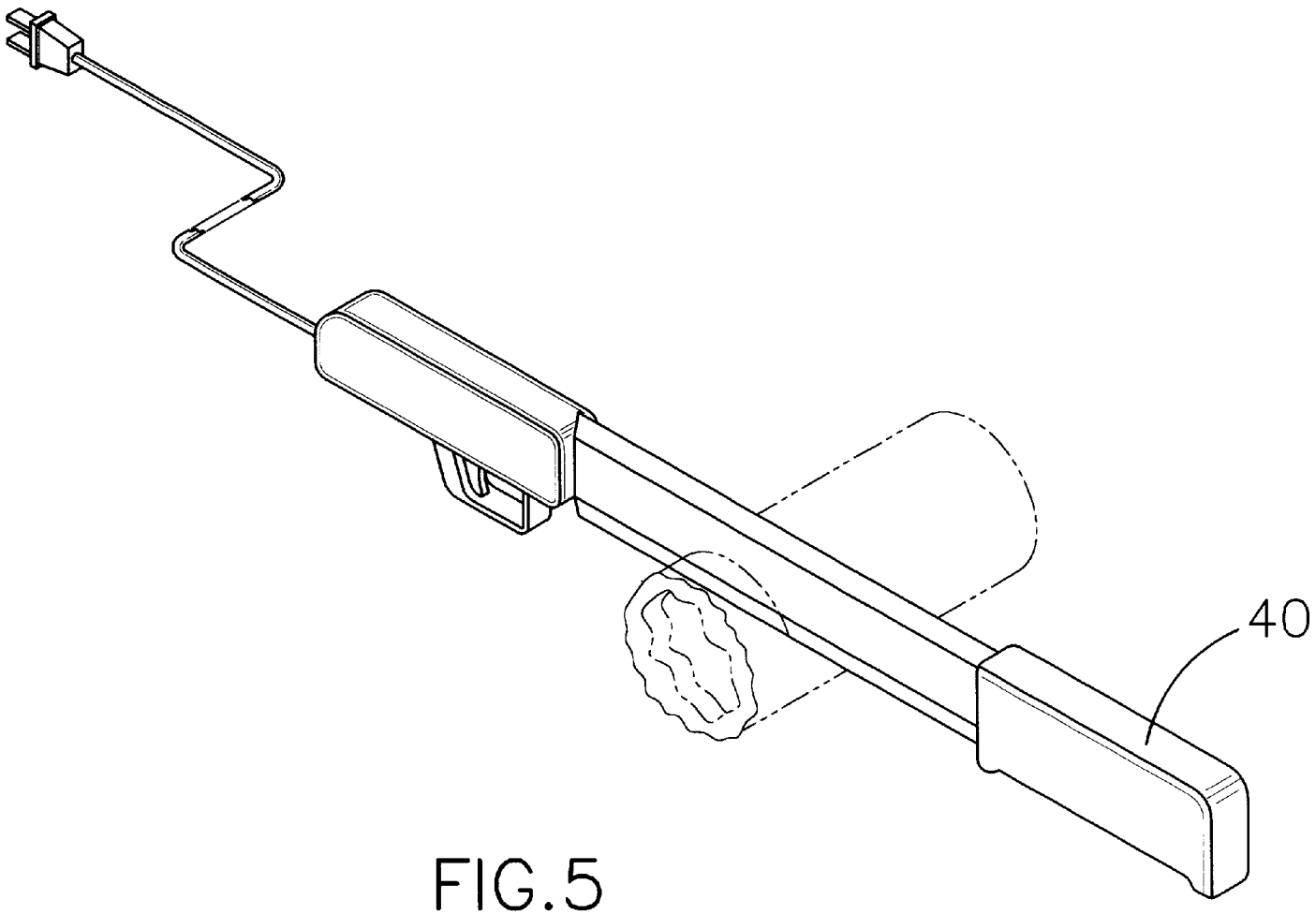
FIG. 5 is a perspective view of another embodiment of the present invention.

In one embodiment of the present invention, as illustrated in FIG. 5, an elongated second handle 40 is provided for grasping by a hand of a user. The elongated blade 16 is mounted on and extends between the first 12 and second 40 elongated handles for cutting a candle. The elongated blade 16 extends generally between ends of the first 12 and second 40 elongated handles.

Figure 6:
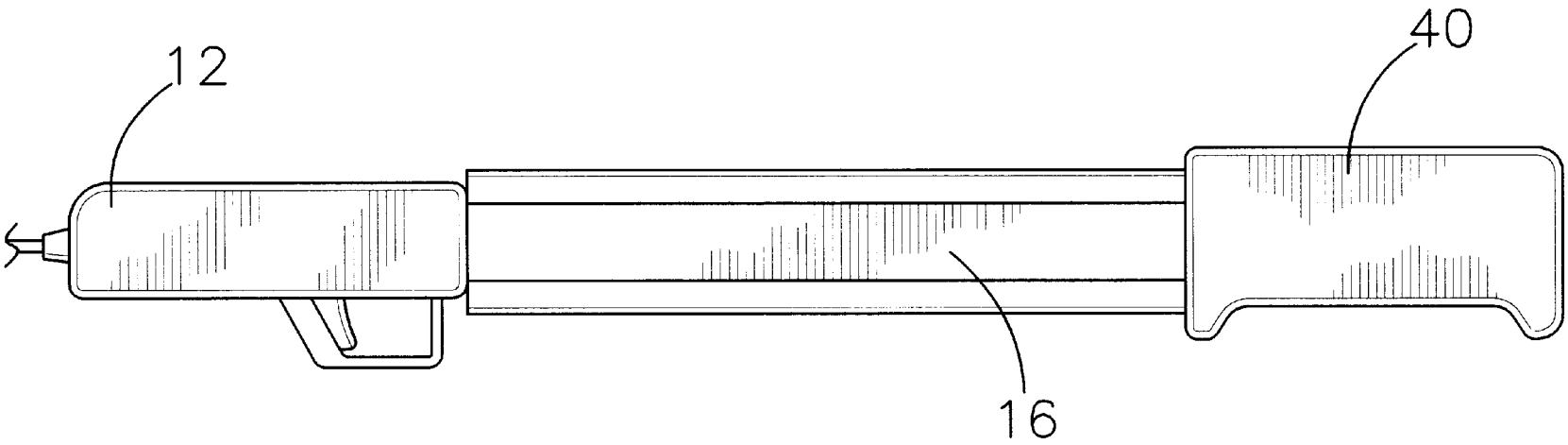
FIG. 6 is a front elevational view of another embodiment of the present invention.

As illustrated in FIGS. 5 and 6, a width of a central portion of the elongated second handle 40 may be generally less than a width of a pair of opposed ends of the elongated second handle 40. The difference in the width of the elongated second handle 40 provides for a better grip by a hand of a user.

In use, the heated candle-cutting device 10 is heated by a user activating the switch 20. The power source 19 heats the heating element 18 extending through the blade 16. A user then places an elongated edge 27 against the candle to be cut. The heated blade 16 permits a user to more easily cut the candle. Once the candle is cut, the heated scoop 30 permits a user to scoop the candle wax away from around the wick so that it can me used. In an embodiment having a second handle 40, a user may exert more downward force by using both handles when cutting a candle.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the heated candle-cutting device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A heated candle-cutting device for cutting candles, said device comprising:

an elongated handle for being grasped by a hand of a user;

an elongated blade mounted on said handle for cutting a candle;

a heating element being mounted in said blade for heating said blade;

a power source being coupled to said heating element for selectively providing power to said heating element;

a switch being mounted to said handle for selectively controlling said power source to said heating element; and a scoop being mounted on a first end of said blade for scooping candle away from a wick of a candle.

2. The heated candle-cutting device of claim 1, wherein said scoop is generally arcuate having a pair of opposed ends, each of said ends being mounted to said first end of said blade.

3. A heated candle-cutting device for cutting a candle, said device comprising:

an elongated first handle for being grasped by a hand of a user;

an elongated second handle for being grasped by a hand of a user;

an elongated straight and rigid blade mounted on and extending between said first and second handles for cutting a candle;

a heating element being mounted in said blade for heating said blade;

a power source being coupled to said heating element for selectively providing power to said heating element; and a switch being mounted to said first handle for selectively controlling said power source to said heating element.

4. The heated candle-cutting device of claim 3, wherein each of said handles has a first end, a second end and a peripheral wall extending therebetween.

5. The heated candle-cutting device of claim 3, wherein said switch is mounted on a peripheral wall of said first handle.

6. The heated candle-cutting device of claim 3, additionally including a guard member being mounted on said first handle and extending over said switch.

7. The heated candle-cutting device of claim 3, wherein said blade has a pair of opposed elongated edges, at least one of said edges being tapered.

8. The heated candle-cutting device of claim 3, wherein said power source comprises an electrical cord for carrying an electric current to said heating element.

* * * * *